US007088837B2

(12) United States Patent
Von Hellermann et al.

(10) Patent No.: US 7,088,837 B2
(45) Date of Patent: Aug. 8, 2006

(54) HIGH EFFICIENCY PLANAR MAGNETIC TRANSDUCER WITH ANGLED MAGNET STRUCTURE

(76) Inventors: Chris Von Hellermann, 1-L5-2 Bellisa Cout, Lorong Leandros, Penang, Kedah (MY) 10250; Dragoslav Colich, 760 W. 16th St., Bldg. C, Costa Mesa, CA (US) 92626

( * ) Notice: Subject to any disclaimer, the term of this patent is extended or adjusted under 35 U.S.C. 154(b) by 373 days.

(21) Appl. No.: 10/640,582

(22) Filed: Aug. 14, 2003
(Under 37 CFR 1.47)

(65) Prior Publication Data

US 2004/0170296 A1 Sep. 2, 2004

Related U.S. Application Data

(60) Provisional application No. 60/402,939, filed on Aug. 14, 2002.

(51) Int. Cl.
*H04R 25/00* (2006.01)

(52) U.S. Cl. ..... 381/191; 381/176; 381/399

(58) Field of Classification Search ..... 381/152, 381/171, 176, 191, 396, 399, 421, 431
See application file for complete search history.

(56) References Cited

U.S. PATENT DOCUMENTS

| | | | | |
|---|---|---|---|---|
| 4,471,173 | A * | 9/1984 | Winey | 381/431 |
| 5,297,214 | A * | 3/1994 | Bruney | 381/431 |
| 5,430,805 | A * | 7/1995 | Stevenson et al. | 381/431 |
| 6,154,557 | A * | 11/2000 | Montour et al. | 381/431 |
| 6,810,126 | B1 * | 10/2004 | Levitsky | 381/191 |
| 6,934,402 | B1 * | 8/2005 | Croft et al. | 381/191 |

* cited by examiner

*Primary Examiner*—Suhan Ni
(74) *Attorney, Agent, or Firm*—Dorsey & Whitney LLP

(57) ABSTRACT

An acoustical speaker and planar magnetic transducer therefore wherein the transducer is provided with at least array of spaced magnets which are oriented having their pole faces at an angle with respect to a plane defining a surface of a sound producing diaphragm on which extends an electrical trace circuit.

19 Claims, 4 Drawing Sheets

HIGH EFFICIENCY PLANAR MAGNETIC TRANSDUCER WITH ANGLED MAGNET STRUCTURE

CROSS REFERENCE TO RELATED APPLICATIONS

This application claims benefit of U.S. provisional patent application Ser. No. 60/402,939, filed Aug. 14, 2002 in the name of the same inventors.

BACKGROUND OF THE INVENTION

1. Field of the Invention

This invention is directed to the field of planar magnetic acoustic transducers and particularly to the use of angled magnetic motor structures for more uniformly driving electrical circuit supporting diaphragms of such transducers in a manner such that the transducers operate at much lower resonant frequencies while reducing distortion of the diaphragms.

2. Description of the Related Art

Audio systems markets desire small flat transducers with improved low frequency output, reduced distortion and enhanced efficiency and power handling. Conventional planar magnetic acoustic transducers include a sound-generating diaphragm, which is mounted within a stator frame. An electrical trace pattern is applied to a surface of the diaphragm and is connected to receive electrical power from a suitable power source. Vibration of the diaphragm is induced by magnetic fields provided by a plurality of magnets that are mounted within the stator frame so as to be in opposing relationship to the electrical trace pattern on one or opposite sides of the diaphragm.

The array of magnets is often referred to as the magnetic motor structure of the transducer. The magnets are generally rectangular bar type magnets that are mounted so as to be in parallel relationship to a plane of the diaphragm. The pole positioning or arrangement of the magnets may vary between transducers.

As the magnet surfaces are typically planar to the diaphragm, the magnetic fields created are localized between edges of adjacent magnets or pole structures within a stator frame. As stated, single sided and double-sided magnetic motor designs have been implemented, with improved linear response being obtained from double-sided designs as the magnetic fields are not fringing on one side. The electrical conductor trace pattern and spacing is designed to ensure the electrical circuit is located in areas of maximum magnetic field strengths created by these drive magnets.

Due to the characteristics of known diaphragm materials and magnetic motor drive structures, smaller planar magnetic transducers do not exhibit efficient low frequency output and often become distorted when power levels are significantly increased. To improve efficiency, it has been proposed to widen the magnetic field profiles associated with the magnets of the motor drive structures by beveling edges of the magnets or by shaping the magnets. However, such proposals have not resulted in significant increase in transducer efficiency in small sized planar magnetic speakers.

SUMMARY OF THE INVENTION

The present invention is directed towards increasing the efficiency and operation of a partially or fully driven planar magnetic transducer, improving the low frequency performance through greater tolerance of larger gaps between the transducer diaphragm and driving motor magnets and lowering distortion through an improved uniformity of the driving magnetic fields for the purpose of dramatically spreading the magnetic field distribution by an order of magnitude.

It is an object of the invention to improve the efficiency, low frequency response and distortion levels of a planar magnetic transducer by employing an angled magnet motor structure that widens the magnetic field profile at the diaphragm. Reducing resonance and providing efficient field coupling in a partially driven area of a diaphragm represents a significant improvement over known transducer designs. A transducer using the magnetic motor of the present invention can operate at a much lower frequency while operating with suitable efficiency over a wide range. To state this another way, it is an object of the invention to increase the width region of a uniform magnetic field in a planar magnetic transducer so as to improve uniform driving of the diaphragm and to provide improve power handling. This enables new application and systems designs for planar magnetic transducers.

BRIEF DESCRIPTION OF DRAWINGS

A better understanding of the invention will be had with reference to the accompanying drawings, wherein.

DESCRIPTION OF THE PREFERRED EMBODIMENT

Figure 1:
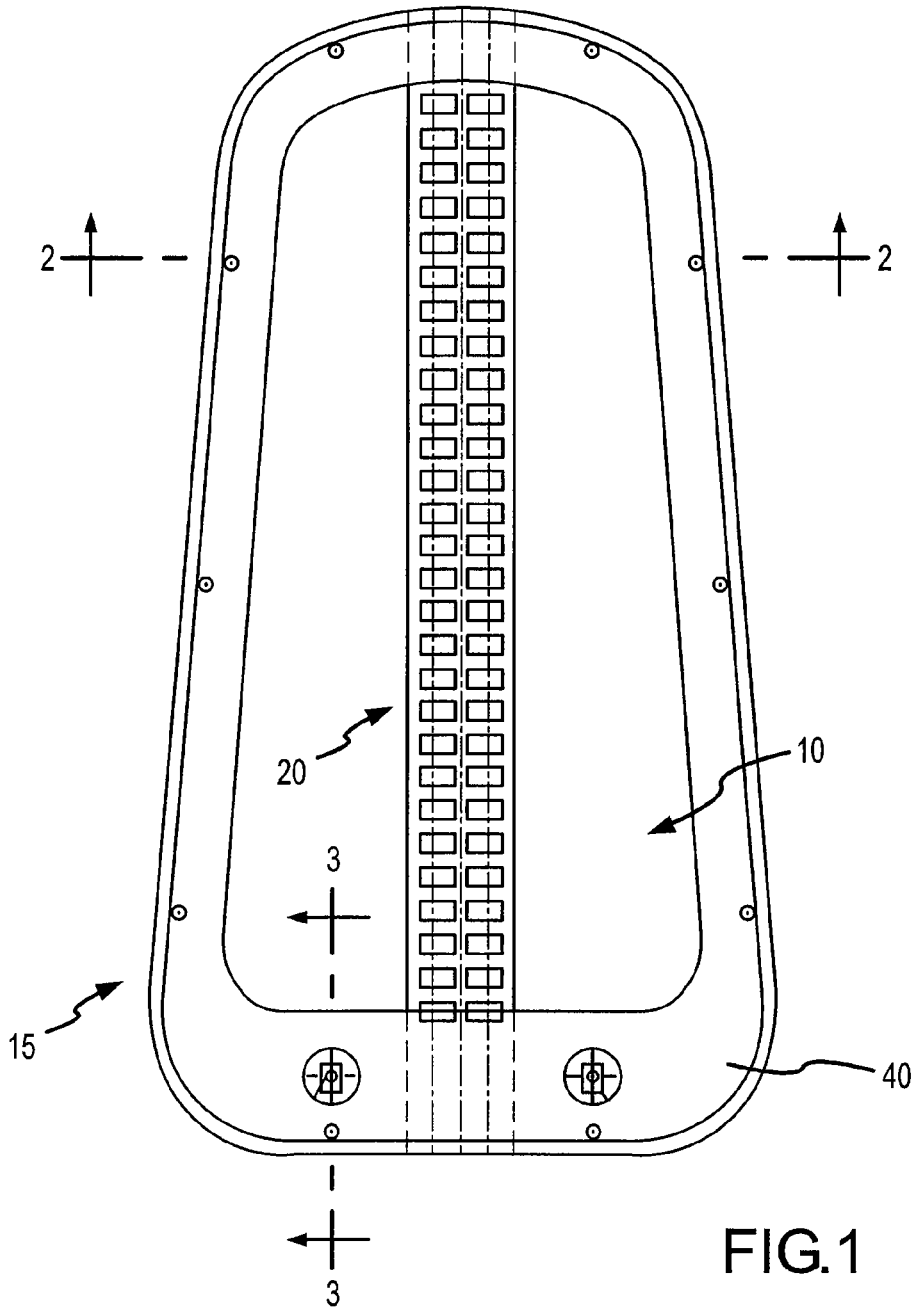
FIG. 1 is a front elevation view of a planar magnetic transducer showing an angled magnet motor structure in a line driver configuration within a tapered stator frame in accordance with the invention.

A first embodiment of angled magnetic motor structure 20 for a planar magnetic acoustic speaker 15 is shown in FIGS. 1–3 and 5. In this embodiment, a transducer diaphragm 10 formed of a conventional material is shown mounted between frames 40 and 41 which are joined to form the transducer stator. The stator or speaker 15 is designed to be mounted with a housing (not shown) of the speaker. It should be noted that the frame may be formed of a single frame component as opposed to the two shown in the drawings.

Figure 5:
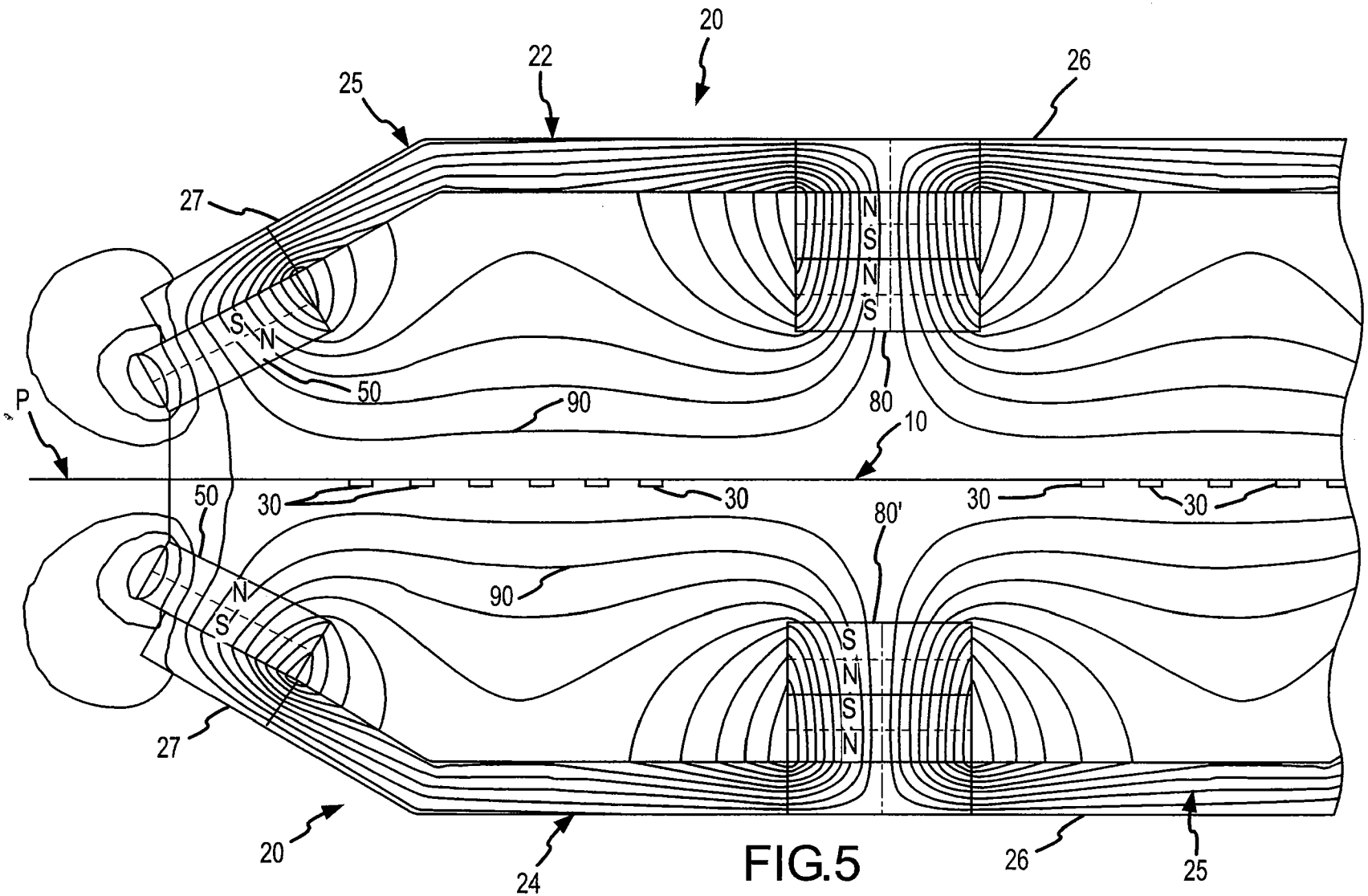
FIG. 5 is an enlarged view of the magnetic motor structure shown in FIG. 2 wherein angled magnet arrays are provided on opposite sides of the diaphragm and also showing double magnets in the center of each array and wide magnetic field coverage obtained.
Figure 6:
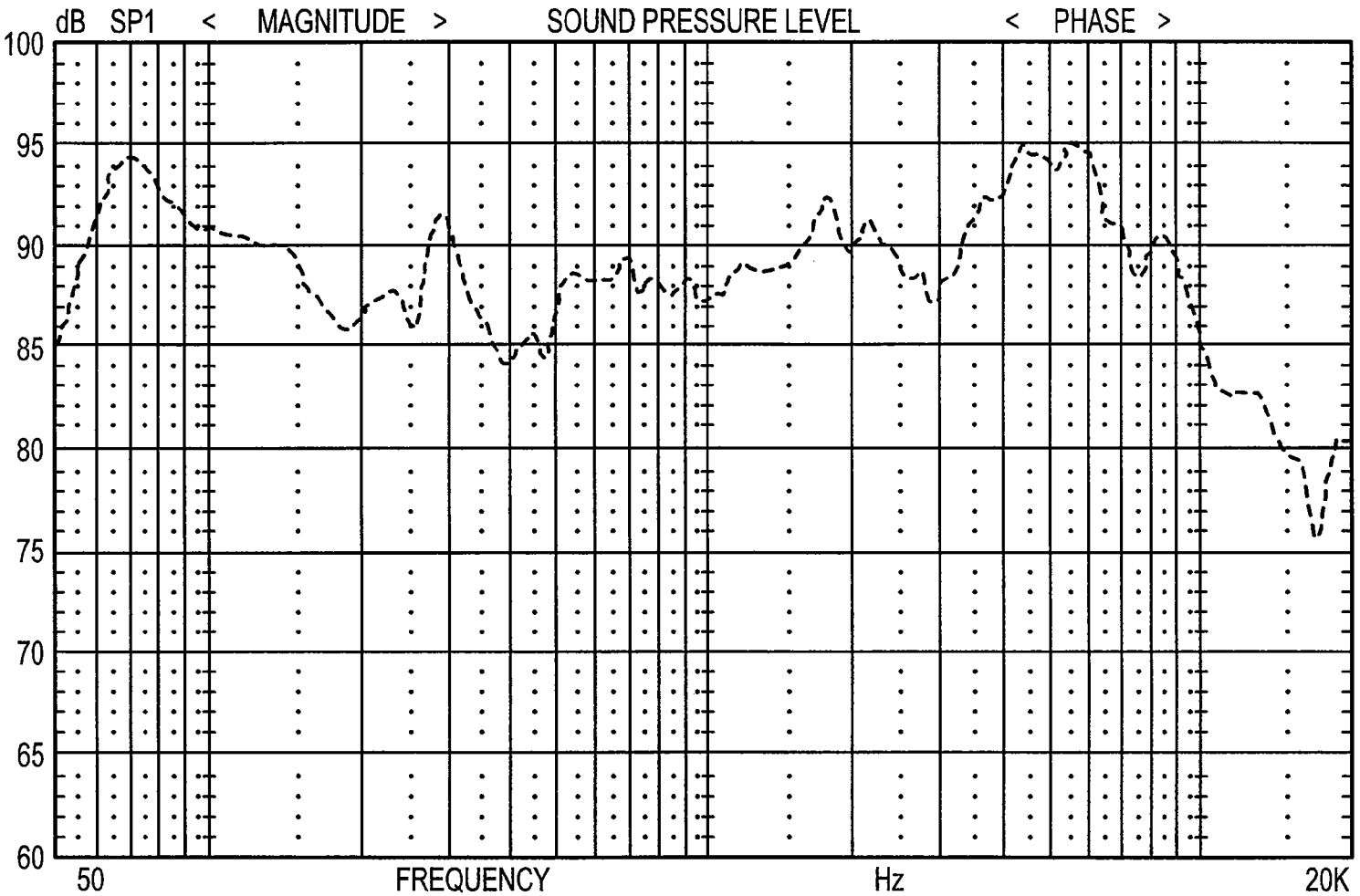
FIG. 6 is a plot showing a low frequency response of the diaphragm of the invention.

A metallic electrical circuit trace pattern 30 is applied to one surface of the diaphragm 10, see FIG. 5. The magnetic motor structure 20 includes two angled magnet arrays 22 and 24 which are disposed within the frames 40 and 41 so as to be oriented on opposite sides of the diaphragm and in generally opposing relationship to the electrical trace pattern 30. Each magnet array includes a support member 25 having a central portion 26 oriented substantially parallel to a plane "P" of the diaphragm and oppositely and inwardly angled side portions 27 and 28. The support member 25 is preferably formed of a ferrous metallic material, which functions as a pole piece to direct lines of magnetic fields from the magnets mounted on the support member to be conveyed there through as is shown in FIG. 5. The support member 25 may also be constructed of a non-ferrous material in which case it would not function as a pole piece and a separate pole piece would have to be provided.

Magnets 50 and 52 are mounted on each of the angled side portions of the support member such that like poles of the magnets oppose each other on opposite sides of the diaphragm. In the embodiment shown in FIGS. 1–3 and 5, the north poles of the magnets 50 on one side of the diaphragm oppose the north poles of the magnets 52 on the opposite side of the diaphragm and the south poles of each of the magnets 50 and 52 are oriented against the support member. Preferably, the magnets 50 and 52 are alike. Mounted centrally of the magnets 50 and 52 on each of the support members 25 are magnets 80. The magnets 80 are mounted such that their poles are oriented opposite those of the magnets 50 and 52. In this manner, the lines of magnetic flux established with each magnetic motor array 22 and 24 are as shown in FIG. 5 with the lines being generally parallel to the electrical circuit trace pattern 30 to thereby provide a wide and uniform area of magnetic driving force to the diaphragm. An alternate embodiment includes a V-shaped support member having a central portion which is not parallel to the plane of the diaphragm.

Figure 2:
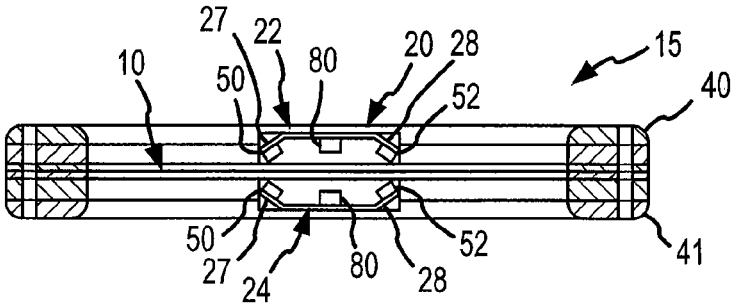
FIG. 2 is a cross sectional view taken along line 2—2 of FIG. 1.
Figure 3:
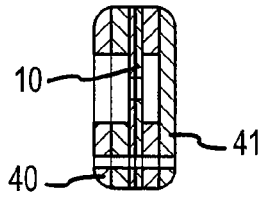
FIG. 3 is a cross sectional view taken along line 3—3 of FIG. 1.

FIG. 2 shows that the separation between magnets 50 and 52 on the angled portions of the motor structure and magnets on the portion 26 parallel to the diaphragm is substantial compared to previous conventional designs and results in a wide uniform magnet field profile. Also, fewer lines of flux are drawn to the support plates or members 25 thus further increasing the available magnetic field at the diaphragm.

The stator frames 40 and 41 are shown as tapered, wider at the lower portion of the stator and narrowing to the top, in this embodiment for reduction of transverse modes in non-driven portions of the diaphragm, however, the invention applies to all types of frame shapes including rectangular. Similarly, in FIG. 1, the magnetic motor structure is shown in a center driven design with reduced driving area, however, the motor structures and conductor traces could be replicated to increase the driven area coverage.

Conductor traces 30 are attached to the diaphragm 10 by a very thin adhesive layer (not shown) as is standard. In a planar magnetic speaker the material of choice for the conductor traces 30, is a soft alloy aluminum. Other conductors mentioned herein can be similarly used such as copper. For many audio products, transducer dimensions are typically rectangular with aspect ratios on the order of 2:1 and greater. Because of the mechanical characteristics of the stretched films used for the diaphragm, the width or narrow dimension of the transducer defines the resonance frequency. Conductor runs are typically lengthwise on a transducer, to minimize resistive losses from the turns. Thus, conductor runs would extend in the long axis of the stator shown in FIG. 1.

The magnet motor structure 20 can be applied independent of diaphragm material or magnet material, and can operate with typical magnet configuration examples such as NSNS orientation. The invention can also be applied independent of magnet material, and preferably uses rare earth permanent magnets such as Neodymium. The magnetic motor structure 20 can also be applied to a planar ribbon transducer (not shown) where the diaphragm is tensioned only along a single axis.

Figure 4:
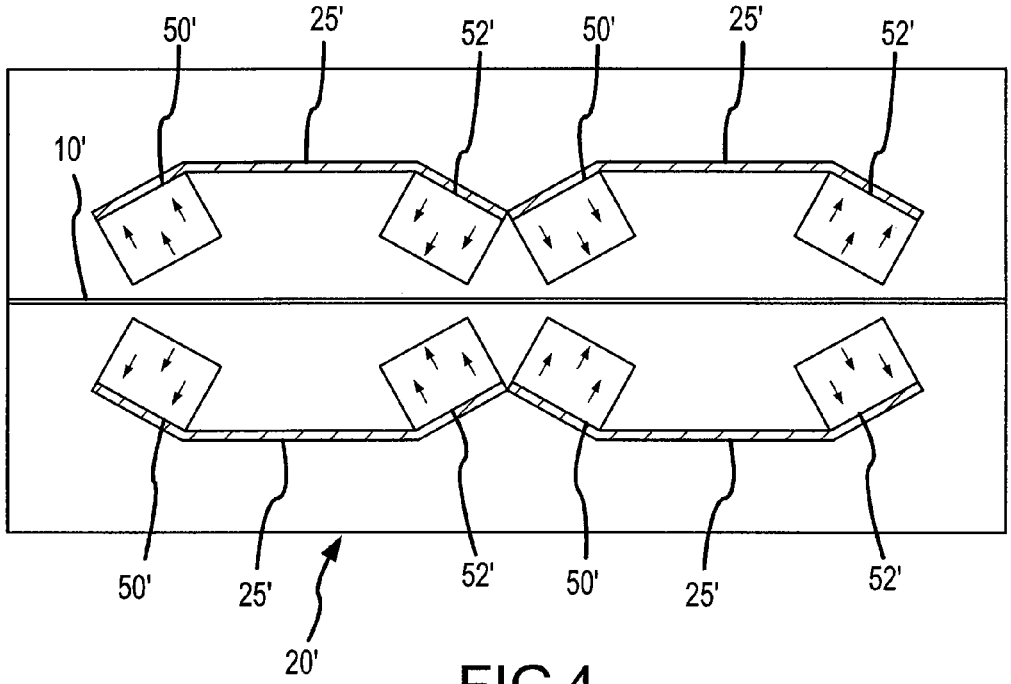
FIG. 4 is a cross sectional illustration showing a basic magnetic motor structure using single magnet elements.

FIG. 4 shows a basic magnet orientation for a variation of angled magnetic motor driver structure 20'. In this example, there is no magnet in the center of the plate or support member 25', and both sets of side magnets 50' and 52' are oriented at an angle relative to the diaphragm 10' to provide an extended field distribution. It should be noted, however, that the poles of each of the magnets 50' and 52' are reversed with respect to one another so that magnetic lines of flux extend along the arrows shown in the drawing figure. In this embodiment, the flux field extends between the side magnets and generally parallel to the diaphragm.

FIG. 5 shows another variation of the first embodiment of the invention, showing the trace patterns 30 on the diaphragm 10 located within a wide field distribution between the angled magnets 50 and 52 and a double or stacked central magnet set 80'. The uniformity of the field lines 90 as a function of excursion from the diaphragm resting position is demonstrated. It will be appreciated that the double magnet set may be one piece or several pieces, which form the same volume as the double stacked magnets. In this embodiment, the uniform field region extends approximately 16 cm on each side of the center magnet or set, where traces can be located.

The use of the wide field motor structure and corresponding conductor layout on the diaphragm 10, increases the output and response of a flat panel stretched membrane loudspeaker by increasing the available area to position electrical circuit traces and maintaining uniformity of the magnetic field. By using the techniques incorporated in this application, significant increases in transducer output have been demonstrated. In combination, the motor structure and conductor pattern can allow the conductor to undergo large excursions while being uniformly driven within the best field portion of the angled motor structure.

A frequency response of the transducer stator of FIG. 1 is shown in FIG. 4, demonstrating a wide frequency range and low resonance at approximately 100 Hz. The mid-range SPL output is suitably high for commercial speaker applications. The large notches in frequency response typical of line driver or transducers with significant passive or undriven diaphragm areas are significantly minimized as compared to prior art transducers. It is obvious to one skilled in the art that standard damping elements can be applied to further smooth the response, such as damping cloth or edge dampers.

Figure 7:
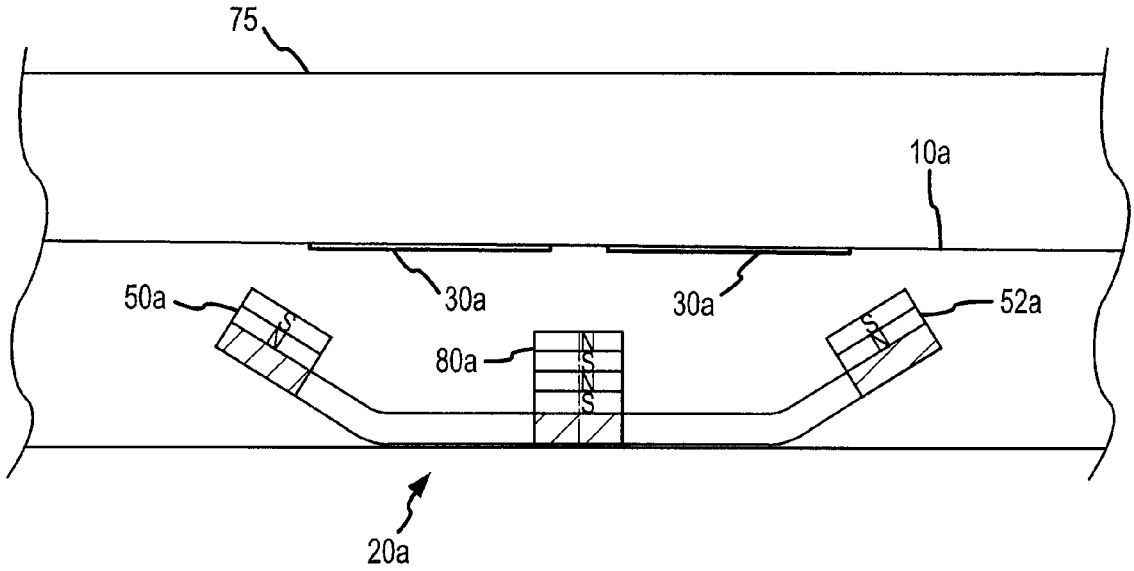
FIG. 7 is a cross sectional view of a single sided magnetic motor embodiment of the invention using neodymium (Nd) magnets.

Another embodiment of the invention is shown FIG. 7 for a single sided magnetic motor driver. The angled motor structure 20*a* in a single-sided planar magnetic speaker 75 is positioned so that corresponding electrical traces 30*a* are located on the diaphragm 10*a* in generally opposing relationship thereto and such that the traces or circuit runs are spaced between the outer angled magnets 50*a* and 52*a* and the central magnets 80*a*. The magnets 80*a* may be stacked or of increased volume as previously described. The diaphragm 10*a* is terminated at the edges of a single stator frame (not shown), as is standard in the industry.

The foregoing description of the preferred embodiments of the invention has been presented to illustrate the principles of the invention and not to limit the invention to the particular embodiments illustrated. It is intended that the scope of the invention be defined by all embodiments encompassed within the following claims and their equivalents.

We claim:

1. A planar magnetic transducer for use with an acoustic speaker, the transducer including; a diaphragm mounted within a frame of a stator, a metallic electrical circuit pattern provided on a surface of said diaphragm at least a portion of which is spaced inwardly of said frame, at least one magnetic motor structure carried within said frame so as to be in spaced generally opposing relationship to said electrical circuit pattern within the stator, said at least one magnetic motor structure including a support member having a central portion and a pair of spaced angled portions, said angled portions supporting spaced magnet elements which are oriented generally at an angle relative to a plane of said diaphragm whereby when electrical power is supplied to said electrical circuit pattern said diaphragm is caused to vibrate by magnetic fields associated with said spaced magnets elements.

2. The planar magnetic transducer of claim 1 including at least one intermediate magnet element mounted between said spaced magnetic elements along said central portion of said support member.

3. The planar magnetic transducer of claim 2 wherein said spaced magnet elements are oriented generally toward one another and said at least one intermediate magnet element.

4. The planar magnetic transducer of claim 3 wherein said support member is formed of a metallic material of a type to function as a pole piece for said at least one magnetic motor.

5. The planar magnetic transducer of claim 3 wherein like poles of said spaced magnet elements are oriented generally toward said diaphragm.

6. The planar magnetic transducer of claim 5 wherein said spaced magnet elements are selected from a group of magnet elements consisting of rare earth permanent magnets.

7. The planar magnetic transducer of claim 1 wherein said central portion of said support member supports a central magnet element having a pole surface oriented toward said diaphragm and generally parallel to said plane of said diaphragm.

8. The planar magnetic transducer of claim 7 wherein said pole surface of said central magnet element is of a polarity opposite that of like pole surfaces of said spaced magnet elements which are oriented toward said diaphragm.

9. The planar magnetic transducer of claim 8 wherein said central and said spaced magnet elements are selected from a group of magnet elements consisting of rare earth permanent magnets.

10. The planar magnetic transducer of claim 8 wherein a volume defined by said central magnet element is greater than a volume defined by each of said spaced magnet elements.

11. The planar magnetic transducer of claim 8 including at least one magnetic motor structure carried with said frame such that at least one magnetic motor structure is provided on each of opposing sides of said diaphragm.

12. The planar magnetic transducer of claim 11 wherein said magnetic motor structures are mounted such that their respective central and spaced magnet elements are aligned with one another on said opposing sides of said diaphragm.

13. An acoustical speaker incorporating the planar magnetic transducer of claim 12.

14. The planar magnetic transducer of claim 11 wherein said frame has a lower portion and an upper portion and side portions which taper toward one another from said lower portion to said upper portion.

15. An acoustical speaker incorporating the planar magnetic transducer of claim 1.

16. A method of increasing the efficiency and lowering distortion of a diaphragm of a planar magnetic transducer having a diaphragm mounted within a stator frame and having an at least one electrical circuit trace pattern on a surface thereof; the method including establishing a magnetic field within the stator frame along at least on side of the diaphragm using spaced magnet elements having like poles which are oriented at an angle relative to a plane of the diaphragm and toward one another.

17. The method of claim 16 including an additional step of establishing the magnetic field through at least one central magnet element disposed intermediate said spaced magnet elements.

18. The method of claim 17 including establishing a magnetic field on opposite sides of the diaphragm.

19. The method of claim 18 including changing lines of flux within the magnetic fields by increasing a volume of the central magnet element relative to a volume of each of said spaced magnet elements.

* * * * *